US007045204B2

(12) United States Patent
Enguchi

(10) Patent No.: US 7,045,204 B2
(45) Date of Patent: May 16, 2006

(54) FRAGRANT ORNAMENT

(75) Inventor: Yasushi Enguchi, Osaka (JP)

(73) Assignee: E-Anthree Systems Inc., Osaka (JP)

( * ) Notice: Subject to any disclaimer, the term of this patent is extended or adjusted under 35 U.S.C. 154(b) by 90 days.

(21) Appl. No.: 10/699,145

(22) Filed: Oct. 30, 2003

(65) Prior Publication Data

US 2004/0096603 A1 May 20, 2004

(30) Foreign Application Priority Data

Nov. 19, 2002 (JP) ..... 2002-334956
Jun. 23, 2003 (JP) ..... 2003-177885

(51) Int. Cl.
*B32B 3/26* (2006.01)

(52) U.S. Cl. ..... 428/304.4; 428/34.1; 428/36.9; 428/320.2; 428/321.1; 428/321.5; 428/905; 428/36; 428/41; 428/42; 428/43; 428/58; 239/34

(58) Field of Classification Search ..... 428/36.9, 428/34.1, 905, 304.4, 320.2, 321.5; 239/34, 239/36, 41, 42, 43, 58
See application file for complete search history.

(56) References Cited

U.S. PATENT DOCUMENTS 4,535,935 A * 8/1985 Spector ..... 239/34
6,705,541 B1 * 3/2004 Schuehrer et al. ..... 239/34

* cited by examiner

*Primary Examiner*—Deborah Jones
*Assistant Examiner*—Abraham Bahta
(74) *Attorney, Agent, or Firm*—Darby & Darby

(57) ABSTRACT

The present invention provides a fragrant ornament that releases fragrance only when people who use the ornament change the shape of the ornament by pulling, kneading and squashing. Also, the present invention comprises a fragrant ornament having a fragrance container, which is made of elastic material and has fragrance release pores that completely or approximately hold the aromatic substance inside and generally release fragrance when the shape of the fragrance container is changed.

17 Claims, 5 Drawing Sheets

(a)

(b)

FRAGRANT ORNAMENT

BACKGROUND OF THE INVENTION

1. Field of the Invention

This invention relates to a fragrant ornament comprising a fragrance container that contains aromatic substance inside, and especially relates to the fragrant ornament that can release aromatic substance only when necessary by pulling, squashing, and kneading the fragrance container.

2. Description of the Related Art

As the conventional fragrant ornaments, there are ornaments that demonstrate fragrant function using a fragrance container made of porous materials such as sponge and the like, thereby exuding the fragrance from the fragrance container.

However, since such ornaments release the fragrance constantly, there still remains the problem of giving people around the fragrance even when unnecessary, and also being uneconomical for consuming large amount of the aromatic substance.

Hence, the purpose of this invention is to provide the fragrant ornament that releases fragrance only when the user changes the shape of the ornament by pulling, kneading and squashing according to need.

SUMMARY OF THE INVENTION

The present invention can overcome the above-mentioned problems, and its purpose is to provide a fragrant ornament, comprising as a part of the ornament a fragrance container which is made of elastic material and has fragrance release pores that completely or approximately hold the aromatic substance inside and generally release fragrance when the shape of the fragrance container is changed.

A fragrance container as mentioned above is preferably capable of deforming elastically obtained by changing its shape, so that the deformation enlarges the effective diameter of the fragrance release pores that generally are the same as or smaller than the effective diameter of the contained aromatic substance.

A fragrance container as mentioned above can be capable of deforming elastically that enables the diameter of its fragrance release pores, which are completely or approximately closed at a steady basis, to become larger than that of the aromatic substance by changing the shape of the fragrance container.

A fragrance container in the above that forms a part of this fragrant ornament can be the ornaments body itself, or a core material that connects the ornament body.

A fragrance container in the above that forms a part of this fragrant ornament can be a cord member attached to the ornament body. The cord member can include, but it is not limited to a string member, a thread member and a yarn member.

A fragrant ornament as mentioned above can be applied to, for example, straps, bracelets, necklaces, key rings, earrings, underwear, shirts, jackets, anklets, straps for glasses, hair bands, employee ID card folders and their straps, belts, buckles, neckties, tiepins, chains for tiepins, brassieres, straps for brassieres, garters, garter belts, footwear, straps for footwear, and antislipping parts for footwear.

Also, a fragrance container as mentioned above or a part of its connected member preferably has an injection hole for injecting the aromatic substance and an exhaust hole for exhausting air.

The above-mentioned injection hole and/or the exhaust hole, which are generally closed or keep the effective diameter smaller than that of the aromatic substance, can change their shapes when injecting the aromatic substance, thereby allowing an aromatic substance injecting device and the air to pass through the holes.

As a typical example of the injecting device as mentioned above, an injector or a needle can be used.

A fragrance container in this invention may comprise one tubular end, a tubular injecting device that is inserted into the tubular end, a fixing member that fixes the tubular end of the fragrance container to the injecting device by insertion, and a cap member that seals the opening of the other end of the injecting device, so that leakage of the aromatic substance from the connecting part between the fragrance container and the sealing cap can be prevented, and solve the problem of uneconomical and unwanted release of the fragrance.

A sealing cap on the fragrance container mentioned above can double as a connecting part with other parts, thereby connecting the fragrance container with accessories and the like, and the fragrant ornament therefore becomes more valuable as an ornament.

An injecting device as mentioned above can comprise connecting function so that the fragrant ornament can be applied to loop ornaments.

The above and other objects features and advantages of the present invention will become apparent from the following description read in conjunction with the accompanying drawings, in which like reference numerals designate the same elements.

DETAILED DESCRIPTION OF THE PREFERRED EMBODIMENTS

A strap related to this embodiment is attachable to, for example, mobile phones and portable communication terminals such as PDAs (Personal Digital Assistants), however its use is not limited.

Figure 1:
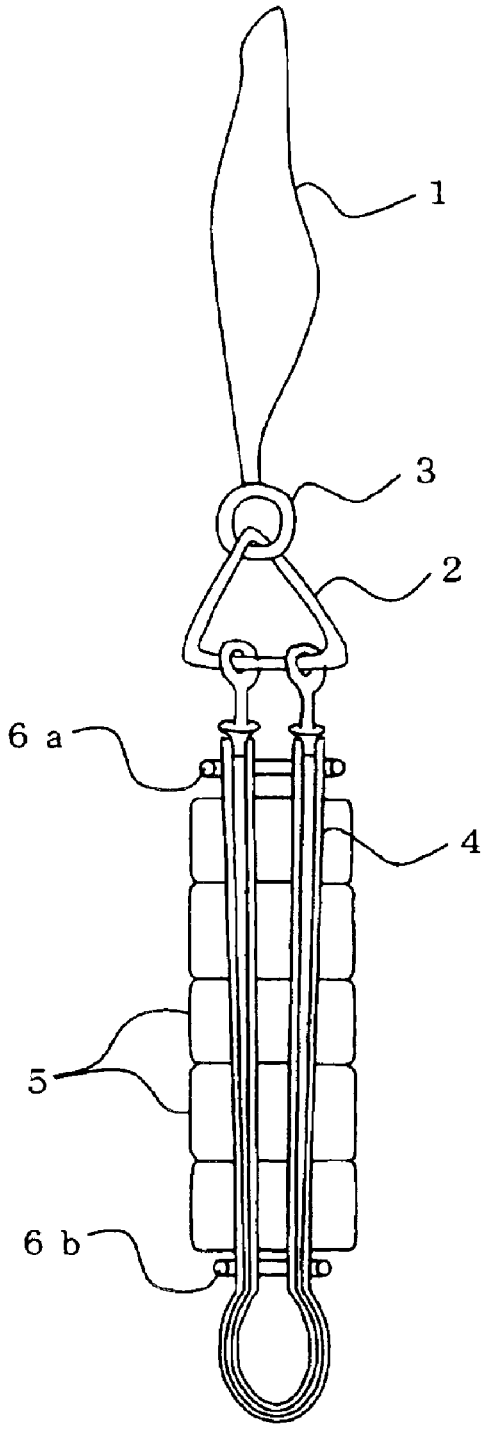
FIG. 1 is a partial cross-sectional view of a strap according to an embodiment of the present invention.

As shown in FIG. 1, a strap S mainly comprises a strap 1 attachable to mobile phones and the like, a holding clasp 2 connected to Strap 1 via a clasp 3, a tubular fragrance container 4 jointed to Holding clasp 2, and an ornament body 5 attached to Fragrance container 4. Here, a 6*a* and a 6*b* are the stoppers to prevent Ornament body 5 from slipping off from Fragrance container 4. In this example, Fragrance container 4 is in a form of cord member, and doubles as a core material joining Ornament body 5 together.

Hereinafter, the details of Fragrance container 4 are explained as referring to FIG. 2*a*. Plugs 7*a* and 7*b* for sealing aperture of the tube ends are attached to both ends of Fragrance container 4 made of elastic plastic. While an injection hole 8*a* is formed in Plug 7*a* so that an injector or a needle is inserted to inject the aromatic substance such as perfumes into Fragrance container 4, an exhaust hole 8*b* is also formed in Plug 7*b* so that the air inside of the tube can escape as the aromatic substance is injected into Fragrance container 4 using the above injector or the needle.

If Plugs 7*a* and 7*b* are made of the elastic plastic, Injection hole 8*a* and Exhaust hole 8*b* can always be closed completely or without leaking the aromatic substance as long as the injection of the aromatic substance is not necessary.

Therefore, it is preferred to form Injection hole 8*a* and Exhaust hole 8*b* of the size of effective diameter that prevent the aromatic substance in Fragrance container 4 from exuding.

Additionally, Injection hole 8*a* and Exhaust hole 8*b* can also be formed in Fragrance container 4 itself.

Figure 2:
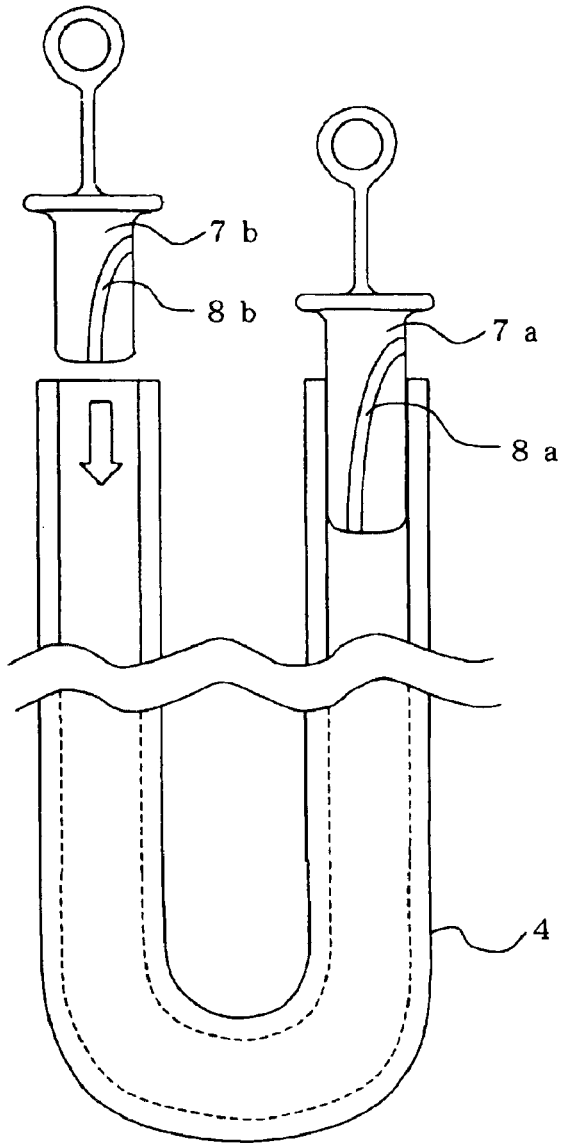
FIG. 2*a* is a partial cross-sectional view of a position of the strap illustrated in FIG. 1.
FIG. 2*b* is a magnified view of the pores of the present invention.
Figure 2:
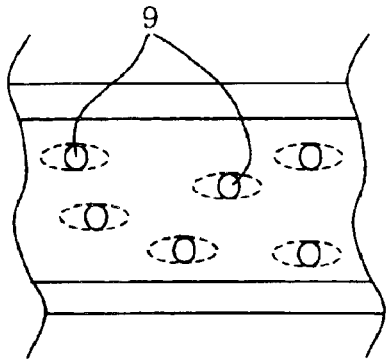
Figure 3:
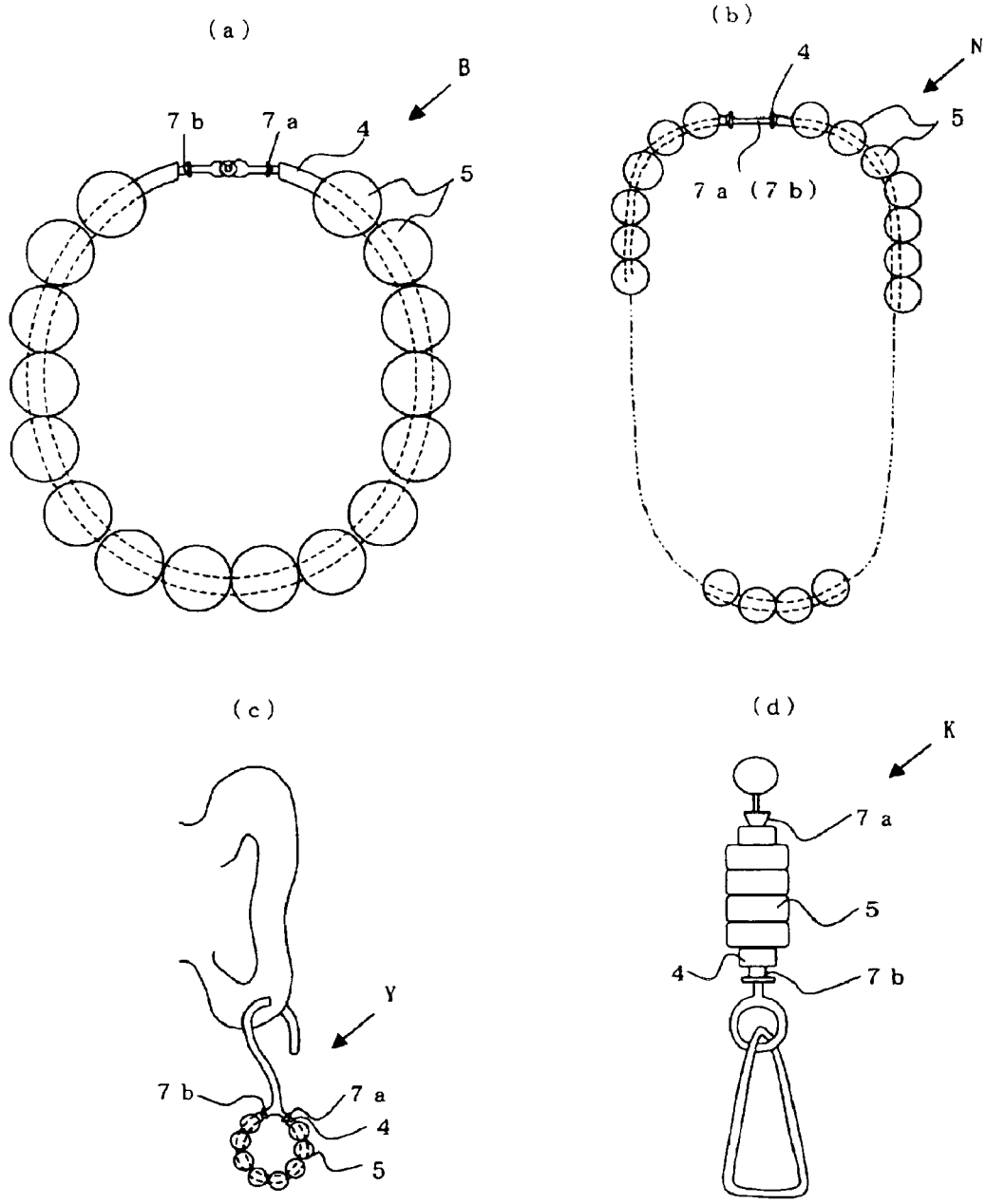
FIGS. 3*a*–3*d* illustrate examples of personal ornaments to which the present invention is adapted.

Also, as shown in FIG. 2*b*, a multiple of fragrance release pores 9 are formed in Fragrance container 4. The effective diameter of Fragrance release pores 9 can be diverse, however they are adjusted to be the same as or smaller than the effective diameter of the aromatic substance in order to completely or approximately prevent the aromatic substance from exuding at a steady basis.

Fragrance release pores 9 are comprised to release the aromatic substance only when they are enlarged as the dotted line shown in FIG. 2*b* by pulling Fragrance container 4. The above Fragrance release pores 9 are easily obtained by forming Fragrance container 4 with elastic porous material whose opening ratio can be adjusted by controlling its content of impurities. Naturally, it is also possible to form Fragrance pores 9 of an appropriate diameter by sticking a needle in the material that does not allow the aromatic substance to pass through.

In the case of Strap S, although the aromatic substance does not completely or approximately exude at a steady basis since Fragrance release pores 9 are small, the fragrance is released only when Fragrance release pores 9 are enlarged as the shape of Fragrance container 4 is changed by pulling and kneading Strap S according to need. Accordingly, Strap S is extremely economical and beneficially effective since the fragrance will not be released in unfavorable atmosphere.

The present invention applies not only to straps, as described above but also to a broad range of ornaments. For example, as shown in FIGS. 3*a*–3*d*, this invention applies to a bracelet B, a necklace N, an earring Y, and a key ring K. In addition, this invention can apply to underwear such as brassieres. The preferred embodiment is to apply this invention to straps of a brassiere so that it releases the fragrance when the straps are pulled. As another applicable example, the present invention can also apply to shirts and jackets. It is possible to enjoy fragrance occasionally by pulling the straps attached to a part of shirts and jackets. Moreover, this invention can also be applied to anklets, straps for glasses, hair bands, straps and folders for employee ID cards, belts, garter belts, buckles, tiepins, chains for tiepins, brassieres, straps for brassieres, footwear, straps for footwear, and antislipping parts for footwear.

In addition, the fragrance container does not always have to be a cord member as a core material, but can be the ornament itself. For example, a container for containing aromatic substance can be formed inside of Ornament body 5 in FIG. 1. With such embodiment, the container for containing aromatic substance can comprise an ornament itself such as Bracelet B, Necklace N, Erring Y and Key ring K shown in FIG. 3, and therefore, the scope of the present invention covers broaches, rings, pendants, belts, belt buckles, wallets, card cases, pass cases, and other ornaments including scent bags that release fragrance. Such embodiment can achieve the fragrance release by kneading ornament itself.

The fragrance release pores in the present invention are not required to hold the effusion of the aromatic substance completely, but required at least approximately by having a certain degree of the effective diameter, since the effect of this invention can be achieved by approximately holding the effusion of the aromatic substance from straps and the like.

Figure 4:
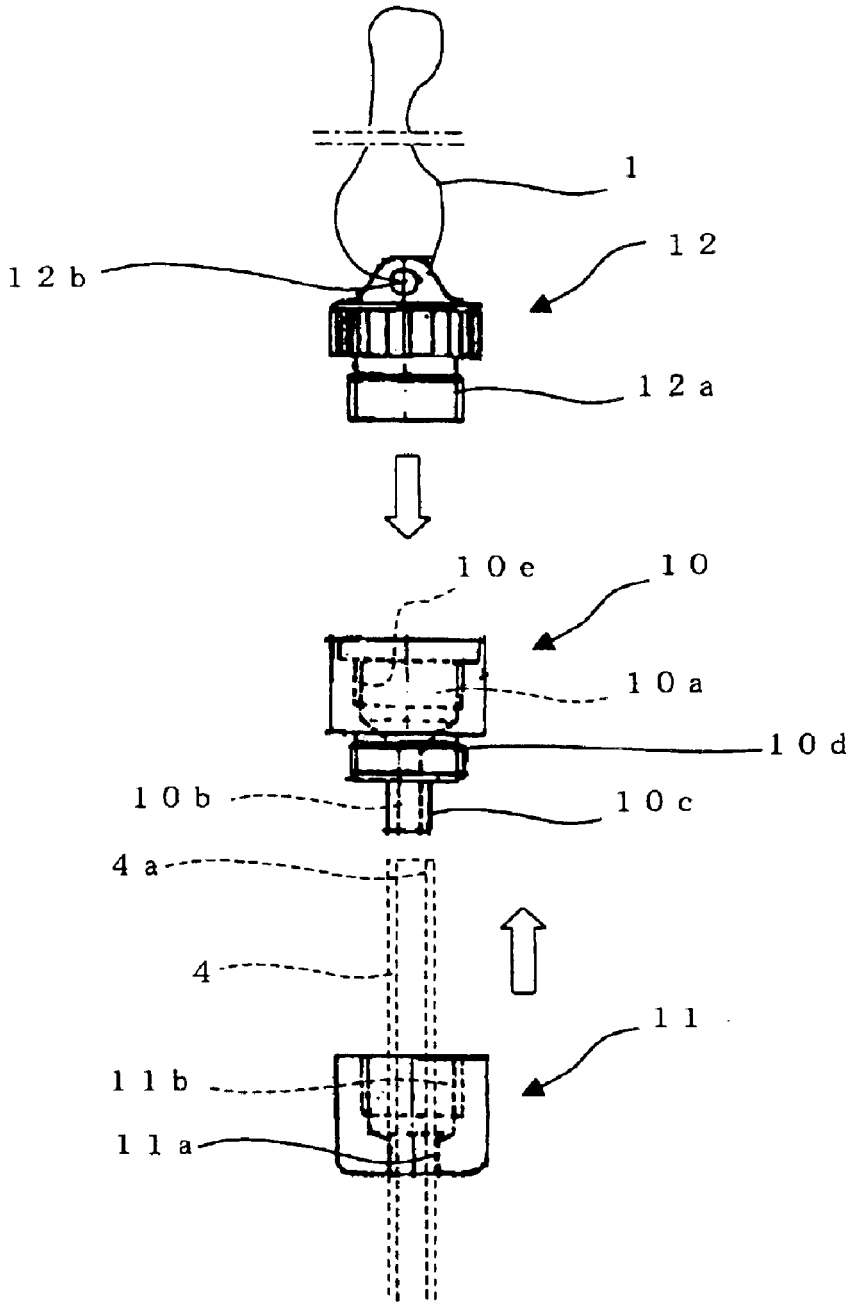
FIG. 4 is a magnified view of a connection available to straps and the like according to the other embodiment of the present invention.
Figure 5:
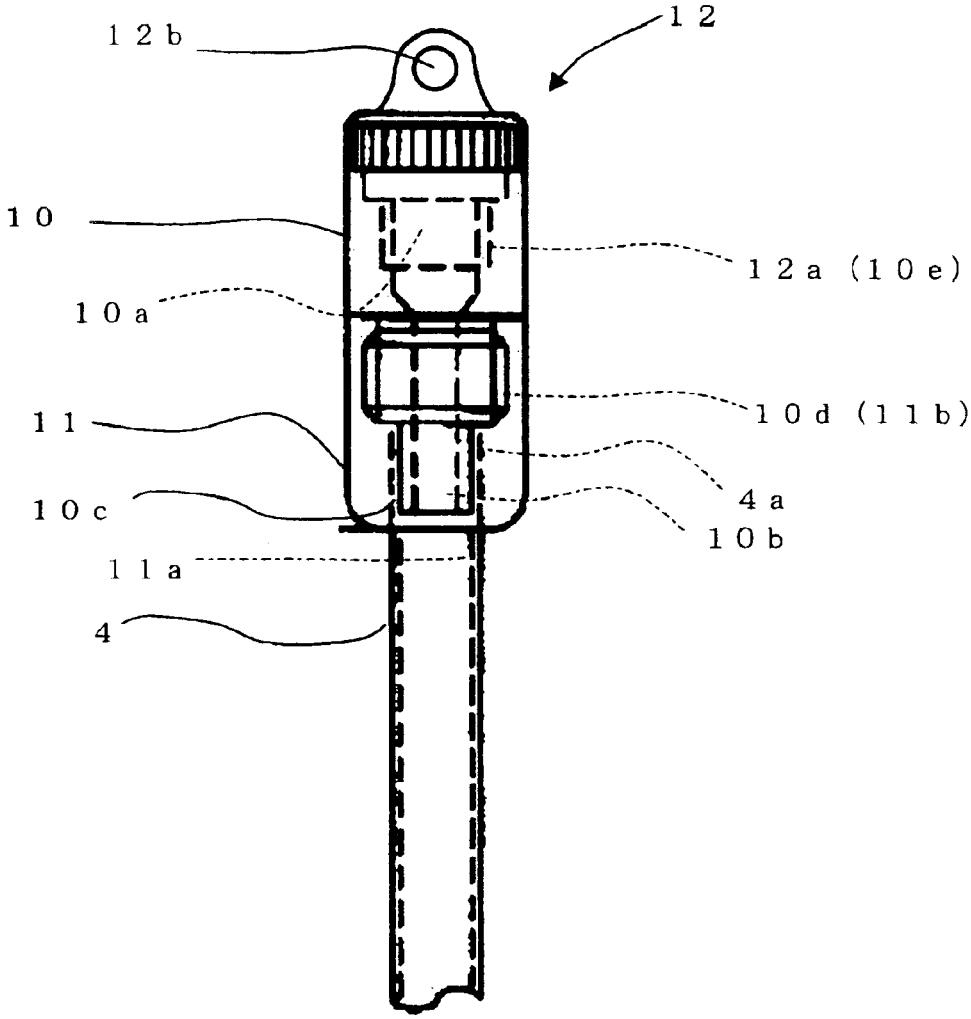
FIG. 5 is an assembled view of the connection illustrated in FIG. 4.

In FIG. 2*a*, the aromatic substance can be injected into Fragrance container 4 from either Injection hole 8*a* or Exhaust hole 8*b* formed in Plugs 7*a* and 7*b*. The improved features of this embodiment are shown in FIGS. 4 and 5. As shown in FIGS. 4 and 5, one end 4*a* of the fragrance container 4 is inserted into one end 10*c* of a tubular injecting device 10 having hollow parts 10*a* and 10*b* that are formed to communicate in the center.

Also, End 4*a* of Fragrance container 4 is fixed to Injecting device 10 by inserting End 4*a* of Fragrance container 4 into a hollow part 11*a* in a fixing member 11, and then screwing a female screw 11*b* of Fixing member 11 on a male screw 10*d* of Injecting device 10 in order to secure Fixing member 11 on Injecting device 10. More specifically, End 4*a* of Fragrance container 4 is fixed in Injecting device 10 by means of Fixing member 11 by inserting End 4*a* of the tubular Fragrance container 4 into one end 10*c* of Injecting device 10.

In addition, the aromatic substance injected from Hollow part 10*a* in Injecting device 10 can not leak from Injecting device 10, since Male screw 12*a* in a cap member 12 is screwed on a male screw 10*e* formed in Hollow part 10*a* in Injecting device 10. The aromatic substance can be refilled with an injector and the like, by removing the Cap member 12, and poring the aromatic substance from Injecting device 10 into Fragrance container 4.

Accordingly, the above structure can solve the problem of leakage of the aromatic substance from the connection between Fragrance container 4 and the cap member, thereby proving as economical, and preventing the trouble of fragrance leakage when unnecessary.

In the above case, the fragrant ornament would be more valuable by forming a latching hole 12*b* in the above-mentioned cap member, and having an ornament such as Strap 1 connected to Latching hole 12*b*.

Certainly, Cap member 12 itself can be formed as Injecting device 10, and both injecting devices can be connected. The loop ornaments such as bracelets and necklaces suit to the above-described structure. As a preferred embodiment of the connection structure, the above-mentioned male and female screw structure can be used. Simple structure like a snap ring can also be used.

As mentioned in the above, the present invention provides a fragrant ornament, comprising as a part of the ornament a fragrance container, which is made of elastic material and has fragrance release pores that completely or approximately hold the aromatic substance inside and generally release fragrance when the shape of the fragrance container is changed. Such fragrant ornament is economical since it releases the aromatic substance only when the shape of the fragrance container is changed by squashing or pulling. Moreover, the fragrance will not be released when unwanted.

A fragrance container as mentioned above is preferably capable of the elastic deformation obtained by changing its shape, so that the deformation enlarges the effective diameter of the fragrance release pores that generally are the same as or smaller than the effective diameter of the contained aromatic substance. This enables the fragrance not to be released unless the shape of the fragrance container is practically changed.

A fragrance container as mentioned above can be capable of deforming elastically that enables the diameter of its fragrance release pores, which are completely or approximately closed at steady basis, to become larger than that of the aromatic substance by changing the shape of the fragrance container. This enables the fragrance not to be released unless the shape of the fragrance container is practically changed.

A fragrance container that forms a part of the above-mentioned fragrant ornament can be the ornament body itself, or a core material that connects the ornament body. When the fragrance container forms as the core material, it can be applied to ornaments such as straps, bracelets, necklaces, key rings, earrings and the like. When the fragrance container forms the ornament body itself, it can be applied to, for example, rings broaches, pendants, buckles, wallets, scent bags, underwear, shirts, and jackets. Also, the present invention can apply to, for example, anklets, straps for glasses, hair bands, employee ID card folders and their straps, belts, buckles, neckties, tiepins, chains for tiepins, brassieres, straps for brassieres, garters, garter belts, footwear, straps for footwear, and antislipping parts for footwear.

A fragrance container that forms a part of the above-mentioned fragrant ornament can be a cord member attached to the ornament body. This enables the fragrance to be released only by pulling the container.

Also, a fragrance container as mentioned above or a part of its connected member preferably has an injection hole for injecting the aromatic substance and an exhaust hole for exhausting air. This enables the aromatic substance to be added when it runs out.

The above-mentioned injection hole and/or the exhaust hole, which are generally closed or keep the effective diameter smaller than that of the aromatic substance, can change their shapes when injecting the aromatic substance, thereby allowing an aromatic substance injecting device and the air to pass through the holes. With a simple structure, such injection hole and the exhaust hole can be formed.

As a typical example of the injecting device as mentioned above, an injector or a needle can be used. They have a convenient structure for pouring the aromatic substance.

A fragrance container as mentioned above can comprises one tubular end, a tubular injecting device that is inserted into the tubular end, a fixing member that fixes the tubular end of the fragrance container to the injecting device by insertion, and a cap member that seals the opening of the other end of the injecting device, so that leakage of the aromatic substance from the connecting part between the fragrance container and the sealing cap can be prevented, and solve the problem of uneconomical and unwanted release of the fragrance.

A sealing cap on the fragrance container as above mentioned can double as a connecting part with other parts, thereby connecting the fragrance container with accessories and the like, and the fragrant ornament therefore becomes more valuable as an ornament.

An injecting device as mentioned above can comprise connecting function so that the fragrant ornament can be applied to loop ornaments such as bracelets.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A fragrant ornament, comprising as a part of the ornament a fragrance container, which is made of elastic material and has fragrance release pores holding a fragrance inside when the container is not under the stress of being stretched and releases fragrance when a shape of said fragrance container is changed by stretching;

wherein said fragrance container further comprises:

a tubular end;

a tubular injecting device inserted into said tubular end;

a fixing member fixing said tubular end of said fragrance container to said injecting device; and a cap member sealing an opening of another end of said injecting device.

2. A fragrant ornament, comprising, as a part of the ornament, a fragrance container made of an elastic material and has fragrance release pores holding a fragrance inside when the container is not under the stress of being stretched and releases fragrance when a shape of said fragrance container is changed by stretching;

where the size of the diameter of the fragrance release pores are changed by the elastic deformation of the fragrance container, so that the diameter of the fragrance release pores is enlarged when the fragrance container is under the stress of being stretched and the diameter is the same as or smaller than the effective diameter of an aromatic particle releasing the fragrance when the container is not under the stress of being stretched.

3. A fragrant ornament, comprising, as a part of the ornament, a fragrance container, which is made of elastic material and has fragrance release pores holding a fragrance inside when the container is not under the stress of being stretched and releases fragrance when a shape of said fragrance container is changed by stretching;

wherein the fragrance release pores, which are at least one of completely and approximately closed when the container is not under stress of being stretched, release at least one of a fluid of the fragrance and a vapor of the fragrance when the fragrance release pores are open and the fragrance container is under the stress of being stretched.

4. A fragrant ornament according to claim 2 wherein the fragrance container is an ornament body.

5. A fragrant ornament according to claim 2 wherein the fragrance container is a core material, connecting at least one of a plurality of ornament bodies.

6. A fragrant ornament according to claim 5 wherein the fragrance container is a cord member attached to an ornament body.

7. A fragrant ornament according to claim 2, selected from the group consisting of straps, bracelets, necklaces, key rings, earrings, underwear, shirts, jackets, anklets, straps for glasses, hair bands, employee ID card folders and their straps, belts, buckles, neckties, tiepins, chains for tiepins, brassieres, straps for brassieres, garters, garter belts, footwear, straps for footwear, and antislipping parts for footwear.

8. A fragrant ornament according to claim 2 wherein at least one of the fragrance container and a member connected to the fragrance container has an injection hole for injecting said fragrance and an exhaust hole for exhausting air.

9. A fragrant ornament according to claim 8 wherein at least one of said injection hole and said exhaust hole, which is normally closed changes shape to pass through said fragrance, fragrance injecting device and air thereinto when said fragrance is injected.

10. A fragrant ornament according to claim 1 wherein said cap member includes a connecting part to connect the fragrant ornament with an accessory.

11. A fragrant ornament according to claim 1 wherein said injecting device comprises a connection mechanism connecting the injecting device to the cap member.

12. A fragrant ornament according to claim 3 wherein the fragrance container is an ornament body.

13. A fragrant ornament according to claim 3 wherein the fragrance container is a core material, connecting at least one of a plurality of ornament bodies.

14. A fragrant ornament according to claim 13 wherein the fragrance container is a cord member attached to an ornament body.

15. A fragrant ornament according to claim 3, selected from the group consisting of straps, bracelets, necklaces, key rings, earrings, underwear, shirts, jackets, anklets, straps for glasses, hair bands, employee ID card folders and their straps, belts, buckles, neckties, tiepins, chains for tiepins, brassieres, straps for brassieres, garters, garter belts, footwear, straps for footwear, and antislipping parts for footwear.

16. A fragrant ornament according to claim 3 wherein at least one of the fragrance container and a member connected to the fragrance container has an injection hole for injecting said fragrance and an exhaust hole for exhausting air.

17. A fragrant ornament according to claim 16 wherein at least one of said injection hole and said exhaust hole, which is normally closed changes shape to pass through said fragrance, fragrance injecting device and air thereinto when said fragrance is injected.

* * * * *